US006167806B1

(12) United States Patent
Chretinat et al.

(10) Patent No.: US 6,167,806 B1
(45) Date of Patent: Jan. 2, 2001

(54) DEVICE FOR CONTROLLING THE PRINTING OF ONE OR MORE WEBS OF MATERIAL IN A ROTARY PRINTING PRESS

(75) Inventors: Michel Chretinat, Agnetz; Henri Pollet, Monchy-Humiere, both of (FR)

(73) Assignee: Heidelberger Druckmaschinen Aktiengesellschaft, Heidelberg (DE)

( * ) Notice: Under 35 U.S.C. 154(b), the term of this patent shall be extended for 0 days.

(21) Appl. No.: 09/266,437

(22) Filed: Mar. 11, 1999

(30) Foreign Application Priority Data

Mar. 11, 1998 (FR) ..... 98 02974

(51) Int. Cl.[7] ..... B41F 13/02; B41F 13/24

(52) U.S. Cl. ..... 101/220; 101/248; 101/DIG. 46; 101/483

(58) Field of Search ..... 101/219, 220, 101/221, 248, 483, 484, 485, 486, DIG. 36, DIG. 46

(56) References Cited

U.S. PATENT DOCUMENTS 4,596,458 * 6/1986 Simeth ..... 101/DIG. 46
4,665,824 * 5/1987 Greiner et al. ..... 101/DIG. 46
4,839,829 * 6/1989 Freedman ..... 101/248
5,043,904 * 8/1991 Sikes et al. ..... 101/248
5,058,500 * 10/1991 Mizuno et al. ..... 101/DIG. 46
5,117,365 * 5/1992 Jeschke et al. ..... 101/248
5,181,257 * 1/1993 Steiner et al. ..... 101/248
5,365,847 * 11/1994 Pers ..... 101/248
5,379,211 * 1/1995 McVenes ..... 101/248
5,649,484 * 7/1997 Broghammer et al. ..... 101/248

FOREIGN PATENT DOCUMENTS 2270180A 3/1994 (GB) .

* cited by examiner

*Primary Examiner*—Eugene Eickholt
(74) *Attorney, Agent, or Firm*—Herbert L. Lerner; Laurence A. Greenberg; Werner W. Stemer

(57) ABSTRACT

A control device for controlling the printing of at least one web of material in a rotary printing press from a control panel, including an interface system between an operator and individual components of the printing press, further includes an automatic page selector, a memory for storing therein information pertaining to the printing press, products to be printed, control parameters of the individual printing press components, and display parameters of printing process variables, an interrogator for interrogating the memory, and a monitoring/control system for passing on all data to the printing press in order to use a selected component and to modify a variable appertaining thereto.

8 Claims, 4 Drawing Sheets

DEVICE FOR CONTROLLING THE PRINTING OF ONE OR MORE WEBS OF MATERIAL IN A ROTARY PRINTING PRESS

BACKGROUND OF THE INVENTION

Field of the Invention

The invention relates in general to rotary printing presses and in particular to a device for controlling the printing of one or more webs of material in a rotary printing press, and to a printing press equipped with such a device.

In conventional printing presses, control and monitoring of the printing of one or more webs are performed by an operator via a remote-control panel. The remote-control panel generally is provided with an analysis table, whereon the operator places the printed copy to be checked.

The remote-control panel also includes a device for controlling the printing of the web or webs of material by a plurality of keys arranged in two rows and disposed immediately below the analysis table, the keys permitting individual control of the opening and closing of the ink duct screws of the various printing units for effecting zonal adjustment of the quantity of ink applied to the web or webs.

The adjusting keys are disposed at a given location and are assigned definitively for controlling an ink duct screw corresponding to the printing of one zone of the web. For zonally adjusting the inking of a printed copy, the operator must therefore necessarily place the copy on the analysis table in a specific manner depending upon the properties of the printing press that is being used, so that each zone of the copy will be positioned opposite the respective adjusting key assigned for controlling the ink duct screw for inking the respective zone of the web of material.

This positioning of the printed copy in a specific manner, with the copy being centered, and the righthand and lefthand sides of the copy being adjusted on the analysis table, is complicated and time-consuming.

The positioning operation also requires that the operator be highly familiar with the printing press he or she is controlling, so that he or she can position the copy correctly relative to the adjusting keys of the control device.

The control device also includes an interface system between the operator and the rotary printing press, and the interface system has a selector for selecting all the functions of the rotary printing press, such as inking, wetting, ink coverage, behavior or characteristics of the web or webs, position of the printed image on the copy relative to the cut of the preceding copy, and accuracy of the folds formed in the copy.

From the control panel, the operator is able to act, with the aid of the control device, upon a confirmation member of the rotary printing press, in order to modify a variable of the printing process corresponding to one of the aforementioned functions.

For example, the operator can act upon a motor of an inking duct screw of an ink duct of a printing unit, in order to change the quantity of ink applied to the copy and, thus, adjust the inking in the printing process.

The operator, for example, can act upon the motors of the angle or turner bars of the paper passage through the printing press, in order to change the position of the image printed on the copy relative to the cut, or the cut position relative to the folds, which is equivalent to the function of positioning the printed image relative to the page or the cut of the printing press.

To that end, the interface system, currently provided between the operator and the rotary printing press in the remote-control panel, is constructed so that controlling the actuation members of the printing press requires that the operator input a given data count or number of discrete amounts of data for performing the remote control.

First, the operator must perform a procedure or process step that may be referred to as "physical mode selection", which calls for inputting, into the interface system of the control device, the web number, web side (two-sided), the color number, and an item of information about the component of the printing press upon which the operator wants to act, such information being in fact the ink duct number or the angle bar number, or the number of the wetting device.

Thereafter, the operator is supposed to select a function of the printing press from the selector of the interface system. This function may be one of the inking, wetting, ink coverage and web behavior functions.

When the product printed by the rotary printing press is a magazine, the operator is able to input, into the interface system of the control device, the web number, the web page (two-sided), and the color number, instead of the "physical mode selection". This procedure is called "page mode selection".

If the product printed by the rotary printing press is a newspaper, the operator can input the page number, the color number, the section of the respective newspaper, the edition and the version.

After the "page mode selection" or "ink ribbon", for example, has been performed, the selection of the corresponding function of the printing press or of the corresponding actuation member is activated with the aid of the control device.

This sequence of operations is rather long and requires beforehand that the operator be very familiar with the rotary printing press that he is operating because, if he should want to modify a variable of the printing process while he is checking a printed copy on the analysis table, he would have to determine the appropriate component of the press, deriving it from the respective page number and his knowledge of or familiarity with the curling tendency layout, i.e., the construction of the printing press, in order to achieve a given product.

The foregoing processes demand an ability to think in a complex manner, which can lead to mistakes and relatively long data input times, which distract the operator from his goal, namely, to act upon the printed copy as quickly as possible to avoid high product rejection rates.

To overcome the aforementioned disadvantages of the prior art, it is accordingly an object of the invention to provide a device for controlling the printing of one or more webs of material in a rotary printing press, permitting a significant reduction in the data which an operator must detect at the control panel, so that the operator can act very quickly upon an actuating member of a press component during the printing process without requiring the operator absolutely to have a thorough knowledge of the construction of the printing press that he is using.

With the foregoing and other objects in view, there is provided, in accordance with one aspect of the invention, a control device for controlling the printing of at least one web of material in a rotary printing press from a control panel, including an interface system between an operator and individual components of the printing press, comprising an automatic page selector, a memory for storing therein information pertaining to the printing press, products to be printed, control parameters of the individual printing press components, and display parameters of printing process variables, an interrogator for interrogating the memory, and a monitoring/control system for passing on all data to the printing press in order to use a selected component and to modify a variable appertaining thereto.

In accordance with another aspect of the invention, there is provided a control device for controlling the printing of at least one web of material in a rotary printing press from a control panel including an analysis table for receiving thereon at least one printed copy to be checked, the control device having an interface system between an operator and individual components of the printing press, with a selector for selecting all functions of the printing press, comprising an automatic page selector for reading out and determining specifications assigned to the printed copy to be checked, the specifications including a page and web number, respectively, a section of a respective newspaper, one of an edition and a version, respectively, and a page of the respective web, the specifications being formed as a code insertable into an image printed on the copy; a memory device for storing data with respect to the printing press, formation of the products to be printed, curling tendency version, control parameters of various printing press components, and parameters for displaying printing process variables; an interrogator for selecting, on the one hand, from the specifications detected by the automatic page selector and, on the other hand, from specifications input by an operator via the control panel and transmitted by the interface system, wherein the selections by the operator include a selection of the work to be performed by the printing press, a selection of a printing press function to be displayed and changed, respectively, and a color selection, from the data stored in the memory device, the data pertaining to a component of the printing press, a control of the component, and a display of the associated variables, and for forwarding these data to the interface system that is suitable for displaying the variable selected by the interrogator, at the printing press control panel, and has a device by which the operator can act upon the displayed and selected variables from the control panel of the press; and a control and monitoring system suitable for taking into account the data selected by the interrogator via the interface system and the action of the operator at the control panel on the variable selected by the interrogator and for transmitting these data to the rotary printing press in order to use the selected component of the printing press and thus to vary the aforementioned selected variables in the printing process.

In accordance with a further feature of the invention, the control device includes a plurality of keys arranged in a row, under the analysis table of the control panel, the keys serving to open and close ink duct screws of various printing units of the printing press, in order to adjust zonally a quantity of ink applied to each printed copy to be checked, the analysis table having a marking, and the automatic page selector serving to determine the position of a corner of a copy placed upon the analysis table, relative to the marking and for transmitting the position to the interrogator for, in turn, transmitting the position on to the interface system, so that the adjusting keys are assigned relative to the marking on the analysis table as a function of the position of the copy.

In accordance with an added feature of the invention, the automatic page selector includes an optical reader.

In accordance with an additional feature of the invention, the optical reader is selected from the group consisting of a camera and a sensor.

In accordance with yet another feature of the invention, the code incorporated into the image printed on the copy is formed as a bar code.

In accordance with an alternative feature of the invention, the code incorporated into the image printed on the copy is formed as a dot code.

In accordance with a concomitant aspect of the invention, there is provided a rotary printing press for two-sided printing of at least one web with various elements, including printing units, a lateral and circumferential register control device, a paper passage equipped with a set of turner bars, a folder device, and a control panel, comprising a control device for printing the at least one web of material so as to permit an operator to confirm a selected actuation member in one of the various elements, in order to modify a given variable of the printing process that corresponds to a particular function of the rotary printing press.

In particular, the invention proposes a control device for controlling printing of one or more webs of material in a rotary printing press from a control panel that includes a table for receiving at least one printed copy to be checked, this control device having an interface system between an operator and the individual components of the printing press, with a selector for selecting all the functions of the printing press, furthermore comprising the following elements: an automatic page selector for reading out and determining the specifications assigned to the printed copy to be checked, such as the page or web number, section of the applicable newspaper, edition and version, respectively, or page of the applicable web, these specifications taking the form of a code inserted into the image printed on the copy; a device for storing in memory the data concerning the printing press embodiment, the embodiment of the products to be printed, the curling tendency version, the control parameters of the various printing press components, and the parameters for displaying the printing process variables; an interrogator or interrogation device which, on the one hand, from the specifications detected by the automatic page selector and, on the other hand, from specifications input by the operator via the control panel and transmitted by the interface system, which include a selection of the work to be performed by the printing press, a selection of a printing press function to be displayed or changed, and a color selection, can search out or select the data, within the data stored in the aforementioned memory, concerning a component of the printing press, control of the aforementioned component, and a display of the associated variables, and can forward these data to the interface system, which is suitable for displaying the variable selected or searched out by the aforementioned interrogator, at the printing press control panel, and has a device with which the operator can act upon the displayed and selected variables from the control panel of the press; and a control and monitoring or an open and closed loop control system for taking into account the data selected by the interrogator via the interface system and the action of the operator at the control panel on the variable selected by the aforementioned interrogator and for transmitting these data to the rotary printing press, in order to use the selected component of the printing press and thus to vary the aforementioned selected variables in the printing process.

Consequently, with the aid of the control device of the invention, it is a relatively simple matter for the operator, without requiring a very precise familiarity with the rotary printing press he is controlling, to act in the shortest possible time on an actuation member of an element of the printing press, the operator inputting a small amount of data into the interface system at the control panel and having to input only a function to be displayed and/or modified, such as a color selection; a page selector makes it possible to identify automatically the data to be assigned to the copies, and the interrogator which, from these specifications and data input by the operator, enable the selection in the memory of the data pertaining to a corresponding press component and the variable of the printing press to be modified, which corresponds to the previously detected function, and this variable is displayed in such a manner that, via the control panel, the operator need merely act upon this variable in order to modify it during the process of printing the web of material.

In an advantageous feature of the control device according to the invention, wherein the analysis table has a marking, and the automatic page selector for determining the location, relative to the aforementioned marking, of a corner of the copy resting on the aforementioned table, and for transmitting this location or position to the interrogator, that transmits this position on to the interface system in such a manner as to assign the aforementioned adjusting keys relative to the marking on the analysis table as a function of the aforementioned position of the copy.

Thus, the operator should no longer place the copy on the analysis table in an arbitrary manner (centered or firmly wedged on the righthand or lefthand side) in order to act upon the ink duct screws via the control keys corresponding to special zones of the copy, because the automatic page selector, after the copy has been placed arbitrarily on the analysis table, detects the location of one corner of the copy precisely with respect to a reference marking and then makes it possible to associate the adjusting keys to the ink duct screws in accordance with the position of the copy on the analysis table with respect to the reference marking.

This allows the operator to save considerable time in the process of checking the print, and it reduces the effort the operator must exert in order to learn the layout of the rotary printing press.

The invention also proposes a rotary printing press for two-sided printing of one or more webs with various elements, specifically such as printing units, a lateral and circumferential register control device, a paper passage equipped with a set of turner, reversing or inverter bars, a folder device, and a control panel, including a control device for printing the web of material or webs of material, as noted hereinabove, which makes it possible for an operator to confirm a selected actuation member in one of the aforementioned elements, in order to modify a given variable of the printing process that corresponds to a particular function of the rotary printing press.

Other features which are considered as characteristic for the invention are set forth in the appended claims.

Although the invention is illustrated and described herein as embodied in a device for controlling the printing of one or more webs of material in a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
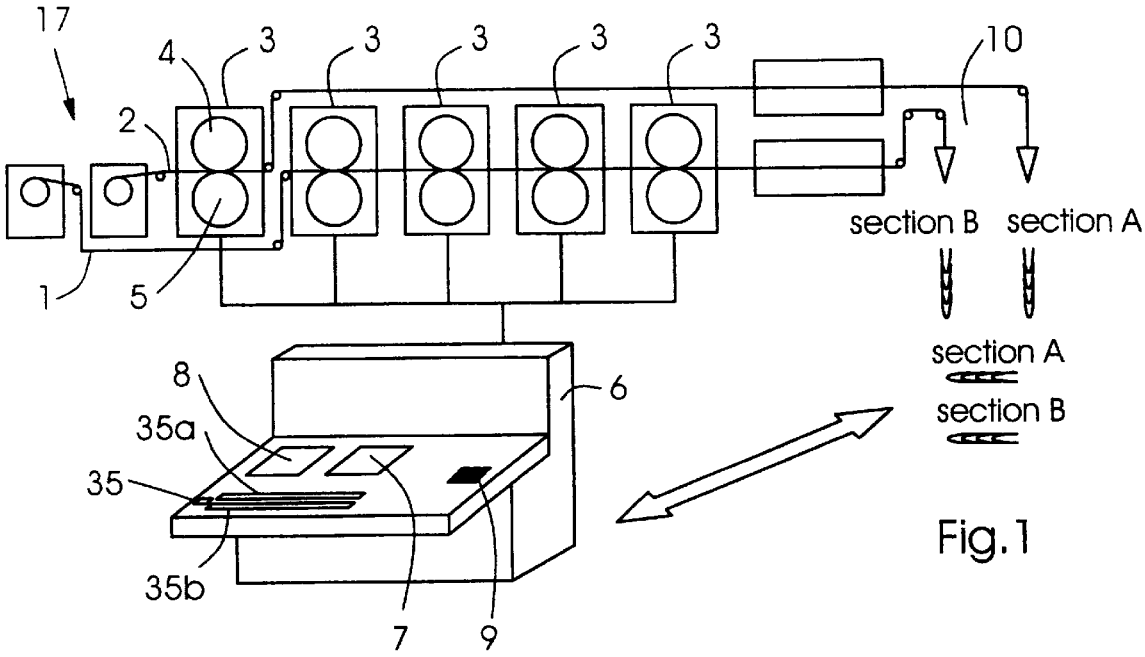
FIG. 1 is a diagrammatic partly elevational, partly perspective view of a rotary printing press according to the invention.

Referring now to the drawings and, first, particularly to FIG. 1 thereof, there are shown diagrammatically therein the main elements of a rotary printing press 17 having two paper webs 1 and 2 unwound from two rolls.

The webs 1 and 2 are tautened and pass through printing units 3 in order to be printed thereat.

Each printing unit 3 has an upper part 4 that includes a plate cylinder, a blanket cylinder, an inking unit, and a wetting unit (all non-illustrated) for printing a front side of each web 1, 2, and a lower part 5, which likewise includes a plate cylinder, a blanket cylinder, an inking unit, and a wetting unit (all also not shown), for printing a back or reverse side of each web 1, 2.

In the example shown, the web 1 is printed in a single color and the web 2 is printed with four mutually adjacent colors, such as magenta, yellow, cyan and black.

The rotary printing press 17 also has a non-illustrated lateral and circumferential register control device, that can restore a lineup or string of colors that may have become defective.

Upon exiting the printing units 3, the webs 1 and 2 take various courses and can, for example, be reversed with the aid of a turner or inverter bar set and disposed above one another before being folded and cut in a folder unit 10 in accordance with arbitrary possible combinations to make up magazines or newspapers.

As is apparent from FIG. 1, a remote control panel 6 is provided, with which the operator can control and monitor the process for printing the webs 1 and 2.

This remote control panel 6 includes an analysis table 7 for receiving at least one printed copy 8 to be checked.

The panel 6 is composed of a control device for printing webs, that has, between the operator and the various components of the printing press 17, an interface system with a selector 9 for selecting a number of functions of the printing presses.

The diverse functions of the rotary printing press 17 selectable by this selector 9 are, for example, the following: inking, wetting, color or ink coverage, attitude of the web or webs, position of the printed image relative to the page or the cut, and accuracy of the folds made in the copies.

The control device on the control panel 6 shown in FIG. 1 includes a group 35 of keys 35*a* and 35*b* installed in a row for individually controlling the opening and closing of the ink duct screw on the various printing units 3 of the rotary printing press, so as to adjust or match zonally the ink quantity that is applied to the printed copy to be checked.

In particular, this group 35 has upper keys 35*a*, which permit the individual control of the opening of the ink duct screws, so as to increase the ink quantity, which shift the ink rollers of the printing units 3 to the web 1 or 2, and lower keys 35*b* for individually controlling the closure of the ink duct screws, in order to reduce the ink quantity, which shift the ink rollers of the printing units 3 to the paper web 1 or 2.

The spacing from one another of the keys 35*a* to 35*b* disposed in a row below the analysis table corresponds to the physical spacing of the various ink duct screws that assures the increase and decrease, respectively, of the quantity of ink in the ink duct.

Described hereinafter in light of FIG. 2, the control device for printing the paper webs 1 and 2 permits action from the control panel upon the variables of the printing process, the variables being modifiable by controlling the actuation members of the individual elements of the printing press, and the printing of the paper webs being adjustable.

Individual physical elements of the press include, for example, the ink duct, the wetting device, the lateral and circumferential registers of the plate and of the crosswise arrangement of the plate cylinder, the withdrawal roller, the controlled rollers, the infeed rollers, the paper passage or flowline, the cylinders of the folding machine, the triangle, and the register.

A special actuation member corresponds to the respective elements and acts thereon to modify a variable of the printing process that corresponds to a function of the printing press. The overall function of the printing press has been described hereinbefore.

Thus, the actuation member of the ink duct of a printing unit of the printing press is a motor of the ink duct screws, that acts upon the ink duct screws or ink jets to open or close them and to change the ink quantity in the printing process, this variable depending upon the ink function.

The wetting device includes, as an actuation member thereof, a wetting water metering device that assures the adjustment of the wetting water in a printing unit, this quantity of wetting water being associated with the wetting function of the printing press.

The actuation member of the lateral register and of the circumferential register of the plate cylinder is a motor that can pull or push the lateral and circumferential register to adjust to or match the ink superposition that corresponds to the function of the coverage of the colors relative to one another in the printing press.

The withdrawal roller, the controlled rollers, and the infeed rollers are actuated by regulating or closed-loop control drive mechanisms that are supported on the rollers and are capable of adjusting the web tension in accordance with the holding function of the web in the printing press.

The paper passage contains turner or reversing bars having an actuation member in the form of a turner or reversing bar motor that can change the position of the printed image relative to the cut, which corresponds to the function of the position of the printed image in relation to the side or the cut of the printing press.

Finally, the cylinder of the folding machine, the triangle and the register include, as the respective actuation members thereof, positioners or motors that can change the precision of the longitudinal cross-folds of the webs and/or of the stitched or stapled booklets thereof, which corresponds to the function of the precision of the folds of the rotary printing press.

The printing control device includes an automatic page selector 13, that can read out and identify the specifications associated with the printed copy to be checked, such as the page or web number, the respective section of the newspaper, edition and version, or the page of the applicable web, these specifications being in the form of a code built into the image printed on the copy. The device 13 may be a camera, a sensor or other optical readers.

Figure 4:
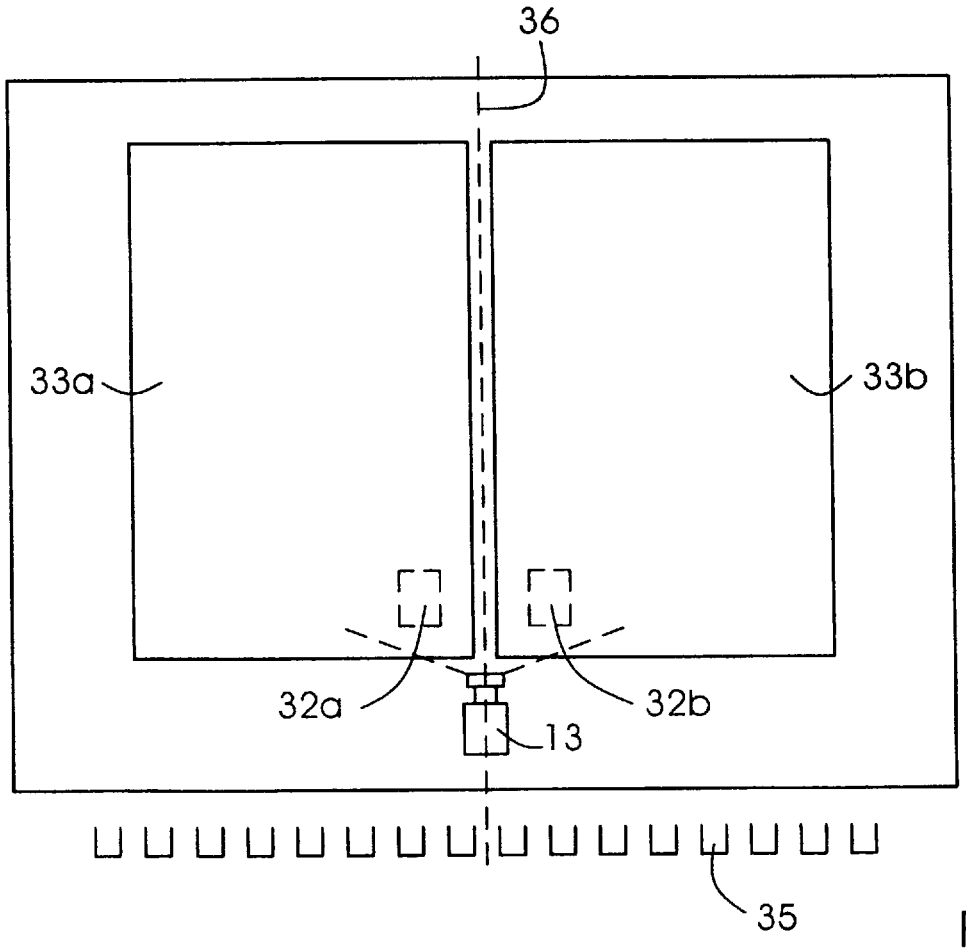
FIG. 4 is a diagrammatic view in the plane of an analysis table of a control panel of the rotary printing press of the invention.

As shown particularly in FIG. 4, a copy 33*a*, 33*b* that rests on the analysis table 7 includes markings 32*a* and 32*b*, which are incorporated into the image printed on the copy.

These markings 32*a* and 32*b* are used to encode the page position in a product.

They can be embodied as a dot code or bar code or as any other encoding system.

These codes 32*a* and 32*b* can be inserted directly onto the image in the case of a digital printing press, or can be created directly on the plates of the plate cylinder of the printing units and engraved on the plate cylinder in the rotogravure process, respectively.

There can also be provided an ink jet printer that, upon each rotation of the blanket cylinders of the respective printing unit, prints the codes 32*a* and 32*b* on each side of the copies, independently of the mechanical triggering of the respective printing unit.

These codes 32*a* and 32*b* containing specifications associated with the copy can be printed only in a single primary color.

Aside from the fact that the automatic page selector 13 can identify the specifications associated with the printed copy to be checked, this selector 13 is also capable of determining the position of the markings 32*a* and 32*b*, which are located on the copies positioned on the aforementioned analysis table, relative to a marking 36, in order to assign adjusting keys 35*a* and 35*b*, provided on the control panel of the printing press, to ink duct screws in accordance with the aforementioned position of the copy relative to the marking 36 on the analysis table.

The automatic page selector advantageously includes a camera 13 that reads the code disposed in the markings of the copy.

The printing control device also has a memory 14 (data base) that collects all the information regarding the rotary printing press 17 and, more precisely, stores the control parameters 21 of the actuation members of the printing press and the display parameters 22 of the appertaining variables.

Figure 3:
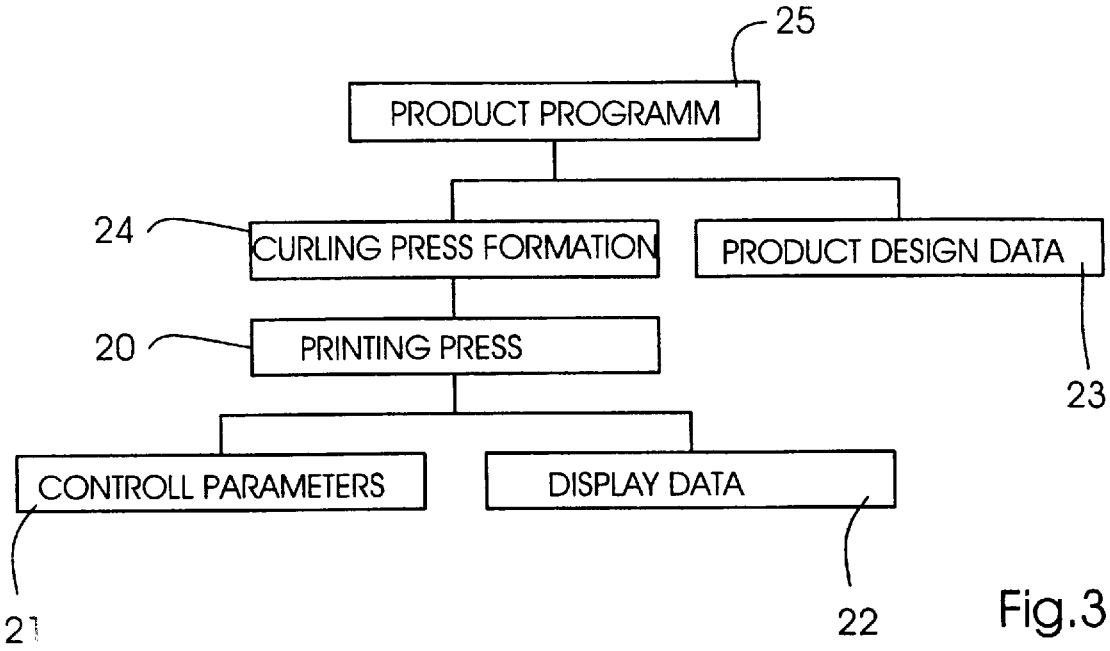
FIG. 3 is a block circuit diagram of a memory of the control device according to the invention.

As is apparent particularly from FIG. 3, the memory 14 is able to store data regarding the particular version of the printing press 20, the design of the products 23 to be printed, the formation of the curling tendency 24, the control parameters 21 of the various components of the printing press, and the display parameters 22 of the variables of the printing process.

The control parameters 21 describe the method for controlling the various physical elements (actuating members of the printing press), so that suitable action can be taken on the variables of the printing process as previously described herein.

For example, the actuation member, which may be a control motor of an ink duct screw, acts upon the variable of the printing process that is made up of a predetermined ink quantity in accordance with the inking function of the printing press.

These control parameters 21 are associated with the version of the printing press but not with the version of the product or curling tendency.

The display parameters 22 of the variables of the printing process explain how the variables of the printing process can be displayed at the control panel for the operator 11. These display parameters 22 are connected with the version of the printing press and the version of the curling tendency.

They are displayed in relationship with the product, and not in relationship with the rotary printing press 17.

The data about the embodiment of the printing press 17 include the identification and the numbering of the individual physical elements of the printing press. They specify the composition of the printing press 17, specifically the number and design of the various elements of the press 17, such as the number of printing units, for example, the type of folding machine, the number of turner or reversing bars, and the number of possible web passages.

This embodiment of the printing press cannot be varied during operation.

The data pertaining to the version of the product 23 correspond to the precise description of the manner in which the printed product is put together: number of sections per bound booklet, number of pages per section, number of colors per page, and size or format.

For example, FIG. 1 shows a finished copy 8 which includes two sections, namely, section A and section B, having 20 pages each, in tabloid size.

The product version obviously does not specify the description of the print content (image).

The data regarding the curling tendency 24 correspond to the type of use of the printing press 17 employed to achieve a specific product version. This version places a connecting member between the printed product and the printing press.

Thus, a particular printed product uses a given number of components of the printing press, for example. An identical product version can be achieved via different curling tendency versions.

The data storage or memory can also store the data about the production program 25 which have been input by the operator before the press is turned on. This production program 25 explains the list of tasks to be performed within a given period of time. A connecting member is formed between the product, described by a product version, and a curling tendency version, which permits the realization of a product of a given printing press.

The printing control device also includes an interrogation device 15 that, on the on the one hand, from the specifications detected by the automatic page selector 13 and, on the other hand, from the specifications input by the operator from the control panel and transmitted by the interface system, these specifications including a selection of the work to be performed by the printing press, a selection of the printing press functions to be displayed and/or modified, and a color selection, can select, from the data stored in the aforementioned memory 14, the particular data pertaining to a specific component of the printing press, the control of the aforementioned component, and the display of the appertaining variable, and can forward these data to the interface system 12.

This interface system 12 can intrinsically display the variable, selected by the aforementioned interrogation device 15, at the control panel 6 and includes a device 37 (note FIG. 6) by which the operator can act upon the displayed, selected variable via the control panel of the printing press.

It should be noted that the automatic page selector 13 transmits the position of the bar or dot code or another encoding arrangement found on the copy, to the interrogation device 15, which passes them on to the interface system so that the adjusting keys 35*a* and 35*b* are assigned to the ink duct screws of the press in accordance with the aforementioned position of the copy relative to the marking 36 on the analysis table 7.

Figure 5:
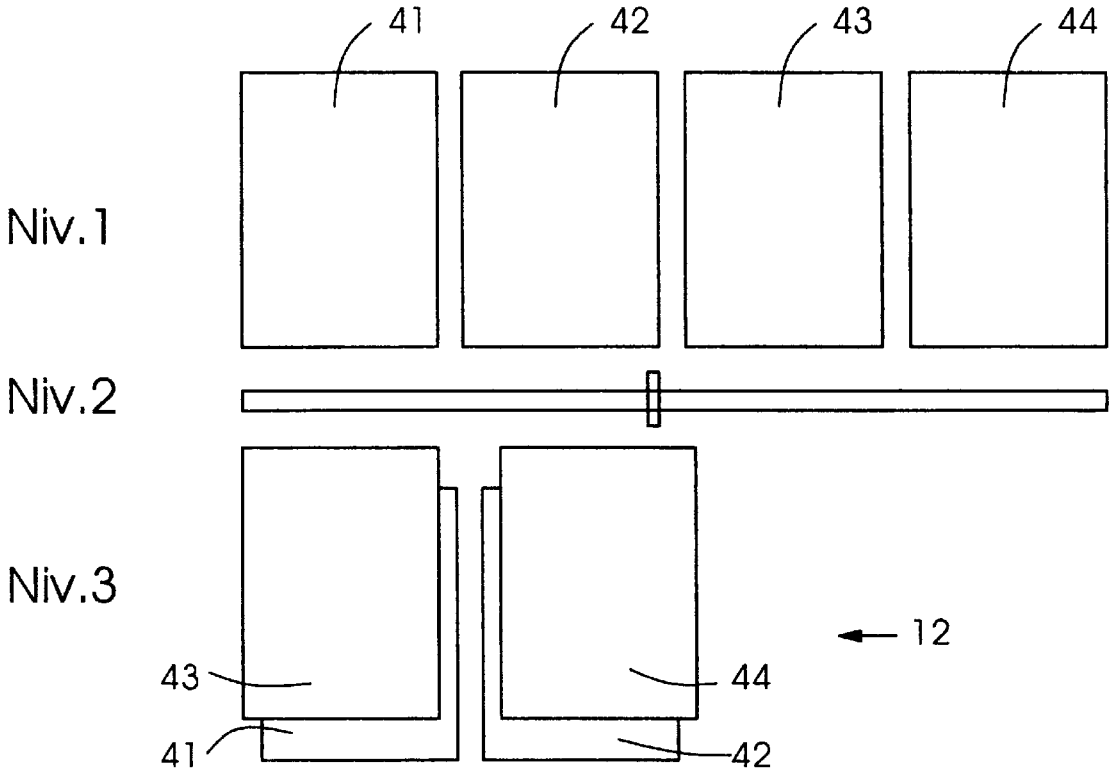
FIG. 5 is a plan view of various timely positions of a printed image in a printing press of the invention.
Figure 5:
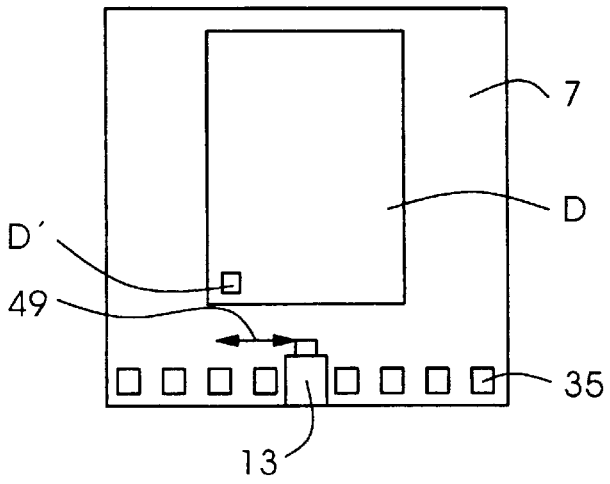

FIG. 5, in particular, shows an example of a rotary printing press having a web width that permits the printing of four pages 41, 42, 43 and 44 per revolution of the plate/blanket cylinders.

One printing unit then prints the yellow color, for example, onto the first two pages 41 and 42, and one printing unit prints the red color for the other two pages 43 and 44, for example (note step 1 in FIG. 5).

For performing the production of an eight-page copy of a newspaper, the web is divided into two strips at the outlet of the printing unit (note step 2, FIG. 5).

The first strip includes pages 41 and 42, and the second strip includes pages 43 and 44.

After the two strips have been placed on one another, the printer receives the desired copy at the outlet of the folder machine (see step 3 of FIG. 5).

The operator, who controls the printing press from the control panel 6, and wishes to check a copy using the print control device, places the copy on the analysis table 7 of the control panel 6, and the automatic page selector 13 detects the code printed on the copy resting on the analysis table 7, in order to identify the page number.

Based upon this information, the automatic page selector 13 is capable, on the one hand, of physically determining how the page is printed in the printing press and, on the other hand, of dynamically effecting the assignment of adjusting keys of the inking unit 35 to the ink modules to be controlled.

With this system, the operator is accordingly relieved of tasks involving positioning of the copy on the analysis table, which saves time for him.

Figure 2:
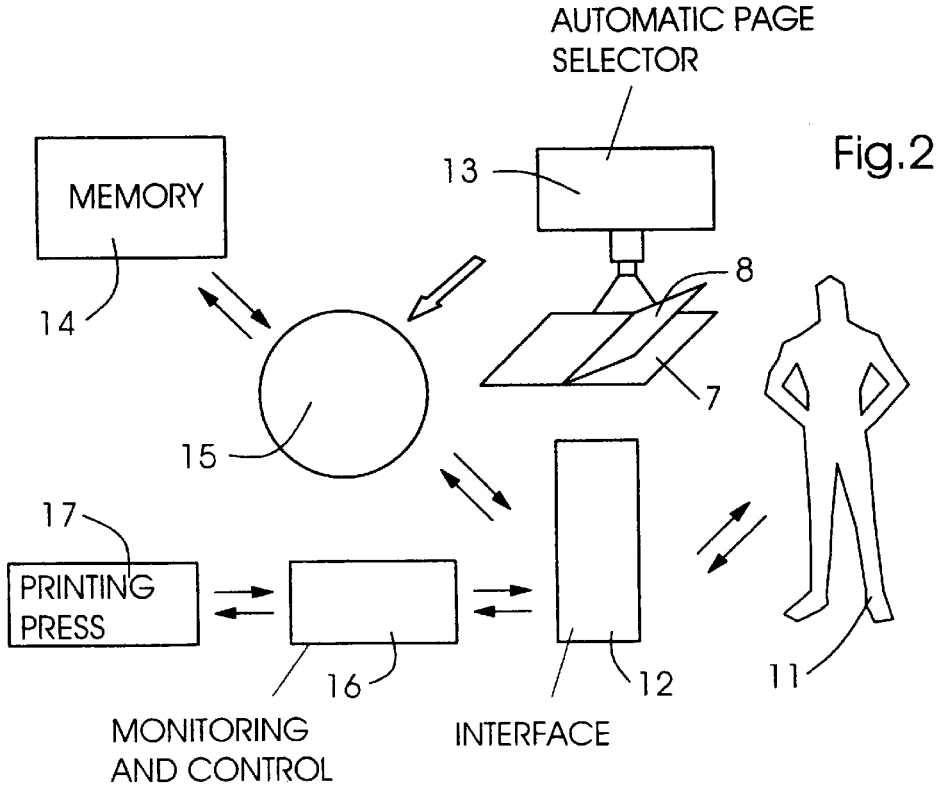
FIG. 2 is a block circuit diagram of the arrangement of different components of the control device according to the invention.

The printing control device shown in FIG. 2 also includes a monitoring/control or an open/closed loop control system 16 which, via the interface system 12, can take into account the data selected by the interrogation means 15 and the action of the operator at the control panel on the variable selected by this interrogation device 15, and transmit all the data to the rotary printing press, in order to confirm the actuation of the actuation member of the respective element of the printing press and change the variables selected in the printing process.

This monitoring/control system 16 is therefore in direct connection with the components of the press 17, as shown in FIG. 2.

The control of printing by the operator from the control panel 6 using the control device described hereinbefore is described hereinafter with regard to FIG. 6.

The operator 11, via the interface system 12, selects a task to be performed, which corresponds to the data of the printing program 25 that are stored in the memory.

Furthermore, if the operator wishes to change a variable of the printing process based upon a copy that he has checked and that is resting on the analysis table, then, via the selector 9, he selects a function, which may be the wetting, the ink coverage, the web attitude, the position of the printed image relative to the sides or the cut, or the accuracy of folding.

To that end, he selects a color.

At the same time, the automatic page selector 13 reads the information associated with the copy, information that is incorporated as a code in the image printed on the copy, and passes this information on to the interrogation device 15.

The data input by the operator at the interface system 12 are also transmitted to the interrogation device 15.

Based upon these specifications transmitted to the interrogation device 15, the latter can obtain the data from the memory 14 that correspond to a particular component (actuation member) of the printing press to be actuated, a controller of the aforementioned component (actuation member) of the printing press, and the display of the appertaining variable.

The display of the appertaining variables is passed on to the interface system 12 again, so that this display can be seen by the operator standing in front of the control panel.

Figure 6:
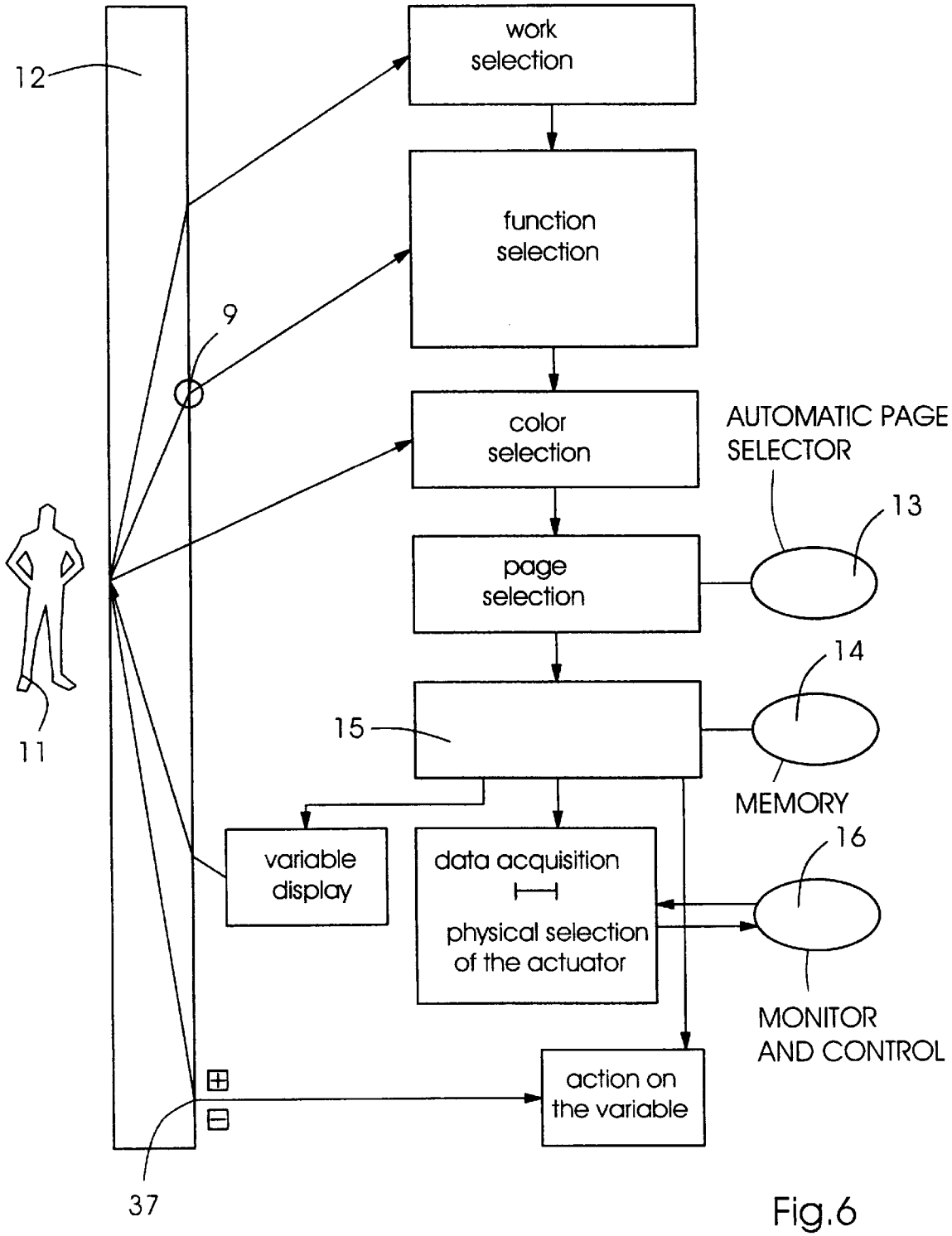
FIG. 6 is a block circuit diagram showing the functioning of the printing control device according to the invention.

The interface system 12 has a device 37, such as a +/− key, as shown in FIG. 6, with which the operator, from the control panel located away from the printing press, can act upon the selected, displayed variable.

The action of the operator via the key 37 and the information arriving from the interrogation device 15 with respect to the physical selection of the actuation member and the control on the actuation member are passed on to the monitoring and control system 16 in such a manner that the corresponding actuation member in the rotary printing press 17 is actuated, and the selected variable in the printing process is modified.

Obviously, the printing control device advantageously includes a manual emergency shutoff system for selecting the information associated with the product, the so-called "page selection", in the event that the automatic page selector 13 should fail.

With the aid of the manual selection, the operator can input the information associated with the product directly at the control panel, that is, the page number, newspaper section, or the front or back side of the web, the edition, and the newspaper version.

This information corresponds to the specifications automatically detected by the automatic page selector 13 while it is in operation.

The invention of the instant application is in no way limited to the embodiments described and shown; a person of ordinary skill in the art can, of course, make any modification therein that he or she wishes.

We claim:

1. A control device for controlling the printing of at least one web of material in a rotary printing press from a control panel, including an interface system between an operator and individual components of the printing press, comprising an automatic page selector for reading out and determining specifications assigned to the printed copy to be checked, said specifications including a page and web number, respectively, a section of a respective newspaper, one of an edition and a version, respectively, and a page of the respective web, said specifications being formed as a code insertable into an image printed on the copy, a memory for storing therein information pertaining to the printing press, products to be printed, control parameters of the individual printing press components, and display parameters of printing process variables, an interrogator for interrogating the memory, and a monitoring/control system for passing on all data to the printing press in order to use a selected component and to modify a variable appertaining thereto.

2. A control device for controlling the printing of at least one web of material in a rotary printing press from a control panel including an analysis table for receiving thereon at least one printed copy to be checked, the control device having an interface system between an operator and individual components of the printing press, with a selector for selecting all functions of the printing press, comprising an automatic page selector for reading out and determining specifications assigned to the printed copy to be checked, said specifications including a page and web number, respectively, a section of a respective newspaper, one of an edition and a version, respectively, and a page of the respective web, said specifications being formed as a code insertable into an image printed on the copy; a memory device for storing data with respect to the printing press, formation of the products to be printed, curling tendency version, control parameters of various printing press components, and parameters for displaying printing process variables; an interrogator for selecting, on the one hand, from the specifications detected by the automatic page selector and, on the other hand, from specifications input by an operator via the control panel and transmitted by the interface system, wherein the selections by the operator include a selection of the work to be performed by the printing press, a selection of a printing press function to be displayed and changed, respectively, and a color selection, from the data stored in said memory device, the data pertaining to a component of the printing press, a control of said component, and a display of the associated variables, and for forwarding these data to the interface system that is suitable for displaying the variable selected by said interrogator, at the printing press control panel, and has a device by which the operator can act upon the displayed and selected variables from the control panel of the press; and a control and monitoring system suitable for taking into account the data selected by the interrogator via the interface system and the action of the operator at the control panel on the variable selected by said interrogator and for transmitting these data to the rotary printing press in order to use the selected component of the printing press and thus to vary the aforementioned selected variables in the printing process.

3. The control device according to claim 2, including a plurality of keys arranged in a row, under the analysis table of the control panel, said keys serving to open and close ink duct screws of various printing units of the printing press, in order to adjust zonally a quantity of ink applied to each printed copy to be checked, the analysis table having a marking, and said automatic page selector serving to determine the position of a corner of a copy placed upon the analysis table, relative to said marking and for transmitting the position to the interrogator for, in turn, transmitting the position on to the interface system, so that said adjusting keys are assigned relative to the marking on the analysis table as a function of the position of the copy.

4. The control device according to claim 2, wherein said automatic page selector includes an optical reader.

5. The control device according to claim 4, wherein said optical reader is selected from the group consisting of a camera and a sensor.

6. The control device according to claim 2, wherein the code incorporated into the image printed on the copy is formed as a bar code.

7. The control device according to claim 2, wherein the code incorporated into the image printed on the copy is formed as a dot code.

8. A rotary printing press for two-sided printing of at least one web with various elements, including printing units, a lateral and circumferential register control device, a paper passage equipped with a set of turner bars, a folder device, and a control panel, comprising a control device for controlling the printing of at least one web of material in a rotary printing press from a control panel, including an interface system between an operator and individual components of the printing press, comprising an automatic page selector for reading out and determining specifications assigned to the printed copy to be checked, said specifications including a page and web number, respectively, a section of a respective newspaper, one of an edition and a version, respectively, and a page of the respective web, said specifications being formed as a code insertable into an image printed on the copy, a memory for storing therein information pertaining to the printing press, products to be printed, control parameters of the individual printing press components, and display parameters of printing process variables, an interrogator for interrogating the memory, and a monitoring/control system for passing on all data to the printing press in order to use a selected component and to modify a variable appertaining thereto.

* * * * *